US008262176B2

(12) United States Patent
Lee

(10) Patent No.: US 8,262,176 B2
(45) Date of Patent: Sep. 11, 2012

(54) REFRIGERATOR

(75) Inventor: Dong Hoon Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 478 days.

(21) Appl. No.: 12/347,183

(22) Filed: Dec. 31, 2008

(65) Prior Publication Data

US 2009/0223243 A1 Sep. 10, 2009

(30) Foreign Application Priority Data

Mar. 5, 2008 (KR) ..... 10-2008-0020408

(51) Int. Cl.
*A47B 96/04* (2006.01)

(52) U.S. Cl. ..... 312/405.1; 312/405; 312/292

(58) Field of Classification Search ..... 312/401, 312/402, 404, 405, 405.1, 406, 406.1, 407, 312/407.1, 276, 325, 274, 272.5, 291, 292; 62/265, 266, 447
See application file for complete search history.

(56) References Cited

U.S. PATENT DOCUMENTS

| | | | | | |
|---|---|---|---|---|---|
| 348,855 | A * | 9/1886 | Millard | 62/266 |
| 367,317 | A * | 7/1887 | Pease | 312/209 |
| 1,417,814 | A * | 5/1922 | Fairweather | 190/16 |
| 1,835,847 | A * | 12/1931 | Chandler et al. | 62/265 |
| 2,136,558 | A * | 11/1938 | Manshel | 62/266 |
| 2,149,114 | A * | 2/1939 | Constantine | 62/377 |
| 2,846,287 | A * | 8/1958 | Gardner | 312/272.5 |
| 3,172,714 | A * | 3/1965 | Kesling | 312/236 |
| 3,212,835 | A * | 10/1965 | Beckett et al. | 312/311 |
| 3,218,111 | A * | 11/1965 | Steiner | 312/405.1 |
| 3,883,204 | A * | 5/1975 | Prada et al. | 312/273 |
| 4,095,439 | A * | 6/1978 | Linstromberg | 62/344 |
| 4,586,347 | A * | 5/1986 | McCarty | 62/265 |
| 2001/0052741 | A1* | 12/2001 | Yun | 312/405 |
| 2005/0073227 | A1* | 4/2005 | Shin | 312/404 |
| 2005/0132535 | A1* | 6/2005 | Jang et al. | 16/357 |
| 2006/0226749 | A1* | 10/2006 | Kim | 312/404 |
| 2008/0018215 | A1* | 1/2008 | Carden et al. | 312/404 |
| 2008/0168794 | A1* | 7/2008 | Cho et al. | 62/441 |

FOREIGN PATENT DOCUMENTS

| | | | |
|---|---|---|---|
| CN | 2323814 | Y | 6/1999 |
| KR | 10-0760403 | B1 | 9/2007 |
| KR | 760403 | B1 * | 9/2007 |

* cited by examiner

*Primary Examiner* — Darnell Jayne
*Assistant Examiner* — Patrick Hawn
(74) *Attorney, Agent, or Firm* — Birch, Stewart, Kolasch & Birch, LLP

(57) ABSTRACT

A refrigerator is provided. The refrigerator includes a main body, a refrigerator door, a homebar door, a basket, and a connecting device. The main body defines a storage compartment. The refrigerator door is pivotably coupled to the main body and defines an opening. The homebar door is on the refrigerator door, to selectively open and close the opening. The basket is pivotably provided on the refrigerator door. The connecting device connects the homebar door and the basket to tilt the basket when the homebar door is pivoted. When the door is pivoted, the basket can easily be tilted.

17 Claims, 11 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2008-0020408 filed on Mar. 5, 2008, which is hereby incorporated by reference in its entirety.

BACKGROUND

Embodiments relate to a refrigerator, and more particularly, to a refrigerator with an improved homebar configuration that allows easy removal and storage of items in the homebar basket.

In general, a refrigerator is provided with a plurality of storage compartments in which to store foods in frozen or refrigerated states, and doors pivotably provided on the storage compartments to selectively open and close the storage compartments.

In refrigerators manufactured recently, a homebar is often further installed on a portion of a door to prevent unnecessary loss of cold air from opening and closing the door. Here, a homebar is an element that allows access to beverages or foods inside the refrigeration compartment without having to open the refrigerator door.

The homebar may be provided with an opening through which items are removed, and a homebar door that opens and closes the opening. Also, a homebar may include a basket provided on a surface of the homebar door to store items such as beverage bottles and water containers.

However, in order to remove items from the basket or store items in the basket, a user experiences difficulties in having to stoop or insert a hand deep inside the homebar because the basket is positioned lower than the opening of the homebar through which items are extracted.

In particular, because beverage bottles with long necks or tall water containers can be stored in a homebar basket, a user experiences the inconvenience of having to tilt such an item when extracting it because it would otherwise catch on the edges of the homebar opening.

SUMMARY

Embodiments provide a refrigerator with an improved homebar configuration enabling items stored in a homebar basket to be easily removed and stored.

Embodiments also provide a refrigerator with a homebar basket that is linked to the opening and closing of a homebar door, in order to facilitate extraction by a user of items stored inside the homebar.

In one embodiment, a refrigerator includes: a main body defining a storage compartment; a refrigerator door pivotably coupled to the main body and defining an opening; a homebar door on the refrigerator door, for selectively opening and closing the opening; a basket pivotably provided on the refrigerator door; and a connecting device connecting the homebar door and the basket, for tilting the basket when the homebar door is pivoted.

In another embodiment, a refrigerator includes; a main body defining a storage compartment; a refrigerator door pivotably coupled to the main body, and defining an opening; a homebar door pivotably coupled to the refrigerator door to selectively open and close the opening; a linking member connected to a side of the homebar door and disposed to pass in forward and rearward directions through the refrigerator door; and a basket provided to be pivotable according to movement of the linking member.

In a further embodiment, a refrigerator includes: a main body defining a storage compartment; a refrigerator door pivotably coupled to the main body, and defining an opening; a homebar door pivotably coupled at a front of the refrigerator door to open and close the opening; a through-hole defined through the refrigerator door at least at one side of the opening; a basket pivotably coupled to a rear surface of the refrigerator door; and a linking member extending forward and rearward of the refrigerator door through the through-hole, and connecting the homebar door and the basket.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present invention, examples of which are illustrated in the accompanying drawings.

Figure 1:
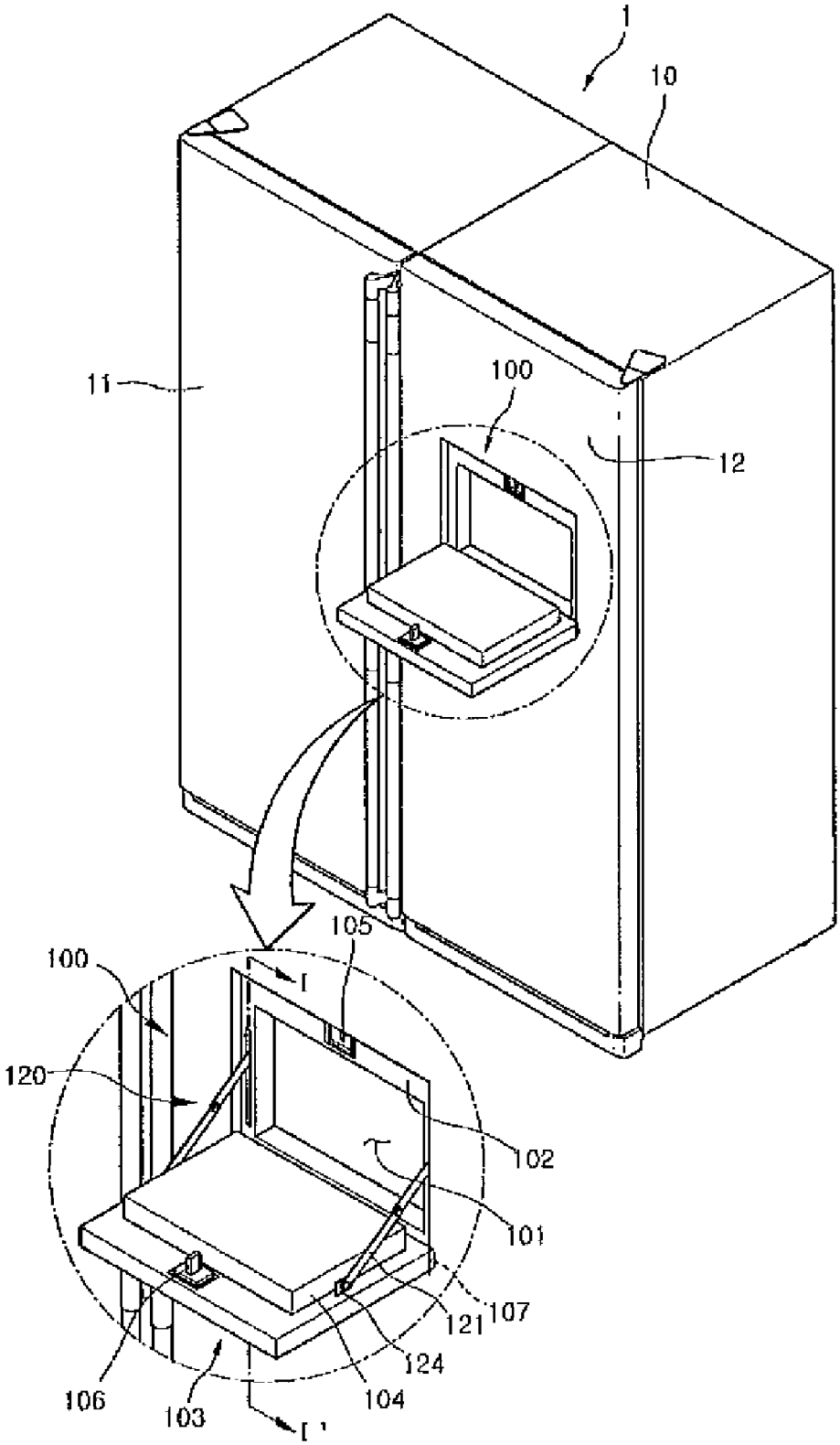
FIG. 1 is a perspective view of a homebar for a refrigerator according to a first embodiment.
Figure 2:
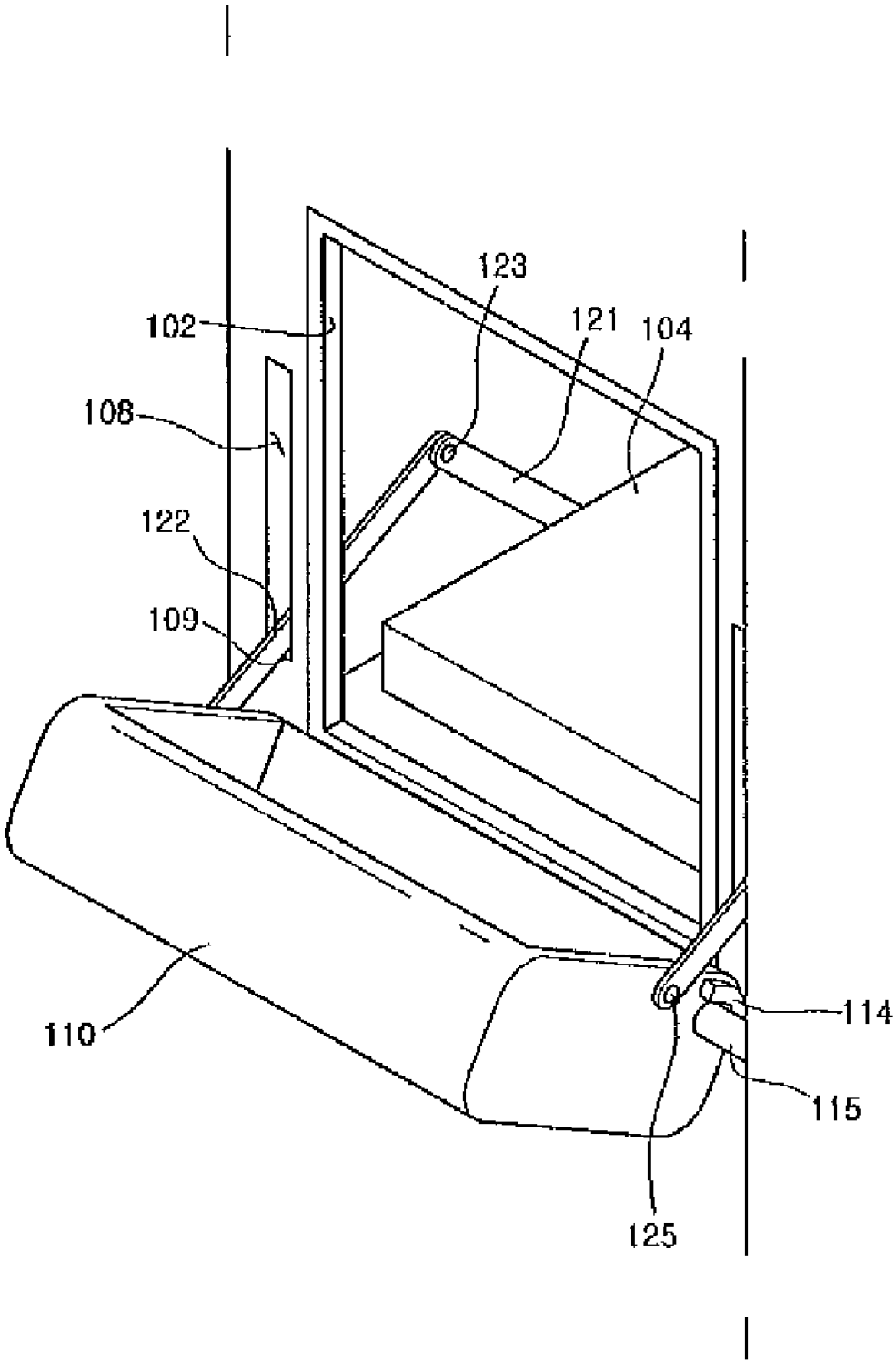
FIG. 2 is a rear perspective view of a homebar for a refrigerator according to the first embodiment.
Figure 3:
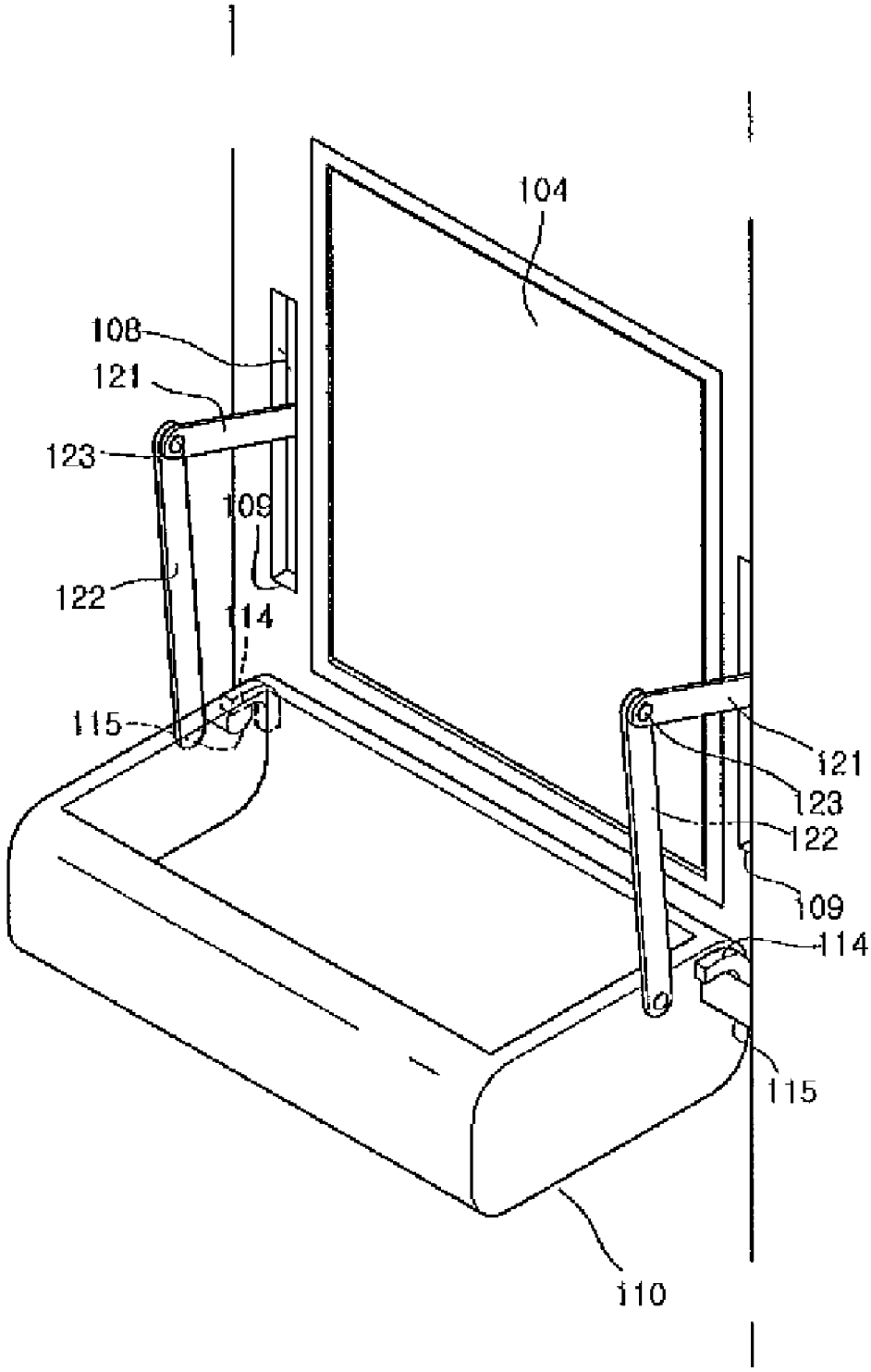
FIG. 3 is a perspective view showing a door of a homebar for a refrigerator according to the first embodiment in a closed state.

FIG. 1 is a perspective view of a homebar for a refrigerator according to a first embodiment, FIG. 2 is a rear perspective view of a homebar for a refrigerator according to the first embodiment, and FIG. 3 is a perspective view showing a door of a homebar for a refrigerator according to the first embodiment in a closed state.

Referring to FIGS. 1 to 3, a refrigerator 1 according to present embodiments includes a main body 10 with an open front defining a freezer compartment and a refrigeration compartment, and a freezer compartment door 11 and a refrigeration compartment door 12 for selectively opening and closing the front of the main body 10.

At the approximate center of the refrigeration compartment door 12 is a homebar 100 provided for a user to easily store and remove comparatively smaller food items.

In the drawings, a side-by-side type refrigerator is exemplarily illustrated, which has a freezer compartment and a refrigeration compartment provided to the left and right of one another. However, the location of the freezer compartment and refrigeration compartment is not an important factor, and present embodiments can equally be applied to top mount refrigerators with the freezer and refrigeration compartments disposed above and below one another, and to bottom freezer refrigerators with the refrigeration compartment disposed on top and the freezer compartment disposed therebelow.

In detail, the main body 10 includes a refrigeration compartment (not shown) in which foodstuffs requiring storage at a higher temperature ranging from 2° C.-5° C. are stored, and a freezer compartment (not shown) in which foodstuffs requiring frozen storage are stored.

Unlike the depiction in FIG. 1, the homebar 100 may be provided on the freezer compartment door 11, or may be provided on both the refrigeration compartment door 12 and the freezer compartment door 11.

In further detail, the homebar 100 includes an opening 101 into and from which food is inserted and extracted, a homebar frame 102 formed around the edges of the opening 101 to define the exterior of the homebar 100, and a homebar door 103 for opening or closing the opening 101. The opening 101 is actually defined in the refrigeration compartment door 12.

Also, a homebar door liner 104 is formed at the rear of the homebar door 103. The homebar door liner 104 is configured to contact the homebar frame 102 and seal the inside of the refrigerator when the homebar door 103 is closing the opening 101.

The homebar door 103 is pivotably coupled about a hinge portion 107 provided at the bottom of the homebar 100.

A latching member 106 that fixes to the homebar frame 102 when the homebar door 103 closes the opening 101 is provided on the inner, upper portion of the homebar door 103.

A latch assembly 105 is provided on the homebar frame 102 to latch with the latching member 106 when the homebar door 103 is closed.

Here, when the homebar door 103 closes, the latching member 106 is inserted in and latches to the latch assembly 105 to maintain the homebar door 103 in a closed state. Also, a pressing portion (to be described below), capable of being pressed by a user to open the homebar door 103, is provided on the front surface of the homebar door 103. Thus, the latching member 106 and the latch assembly 105, together with the pressing portion, can collectively be referred to as an "opening/closing mechanism" for opening and closing the homebar door 103.

Further, a connecting device 120 is provided on the homebar 100 to connect the homebar door 103 to a basket (to be described below) provided on the rear surface of the homebar 100. The basket may be tilted in a predetermined direction by means of the connecting device 120 when the homebar door 103 is opened.

Below, a description of the form and function of the connecting device 120 will be described with reference to the drawings.

Referring to FIGS. 2 and 3, a refrigeration compartment door 12 according to present embodiments is provided with a basket 110 that is tilted in a predetermined direction according to the opening/closing of the homebar door 103, and a connecting device 120 connected to the basket 110 to tilt the basket 110.

In detail, the connecting device 120 includes a first linking member 121 and a second linking member 122 that connect the homebar door 103 and the basket 110.

The first linking member 121 and the second linking member 122 are provided at either side of the opening 101 of the homebar 100. Here, the first linking member 121 and the second linking member 122 may have different link lengths.

The first linking member 121 is coupled to the rear surface of the homebar door 103, and the second linking member 122 is coupled to a side of the basket 110.

The first linking member 121 is connected to a first connector 124 provided on a side of the homebar door 103, and the second linking member 122 is connected to a second connector 125 provided on a side of the basket 110. The first linking member 121 and the second linking member 122 can pivot about the first connector 124 and the second connector 125, respectively.

The first linking member 121 and the second linking member 122 are coupled together at a coupling portion 123. The coupling portion may be provided with a fastening member (not shown) for fastening the first linking member 121 and the second linking member 122.

The first linking member 121 and the second linking member 122 can pivot about the coupling portion 123 with respect to each other.

Also, a through-hole 108 is defined in the refrigeration compartment door 12, through which the first linking member 121 and the second linking member 122 can pass through the refrigeration compartment door 12 and move forward and rearward. The through-hole 108 may be formed at either side of the opening 101.

To enable the linking members 121 and 122 to move forward and rearward in a linked state through the refrigeration compartment door 12, the through-holes 108 may be defined vertically elongated with a length greater than the pivoting radii of the linking members 121 and 122.

A supporting edge 109 is formed on the bottom of the through-hole 108 to support one of the linking members 121 and 122 during forward and rearward movement of the linking members 121 and 122 through the refrigeration compartment door 12.

With the linking member 121 or 122 contacting the supporting edge 109, the supporting edge 109 functions as a lever that transfers driving force from the homebar door 103 to the basket 110.

While not shown in the drawings, the supporting edge 109 may be provided with a supporting member that prevents damage to the inner surface of the refrigeration compartment door 12 from the linking members 121 and 122.

A projecting catch 114 is formed on either side surface of the basket 110 so that the basket 110 catches on the refrigeration compartment door 12. Also, a stopper 115 is provided at a location on the refrigeration compartment door 12 corresponding to the projecting catch 114.

With the basket 110 coupled to the refrigeration compartment door 12, the projecting catch 114 contacts the outside of the stopper 115. The basket 110 may be tilted about the stopper 115.

Specifically, the stopper 115 acts as a hinge enabling tilting of the basket 110, and may be provided with a round sectional shape. One side of the projecting catch 114 may be formed rounded to enable the projecting catch 114 to be guided around the outer periphery of the stopper 115.

The front edge surface of the basket 110 may be formed rounded to allow the basket 110 to be easily tilted about the stopper 115. Here, the basket 110 may be tilted without being impeded by the refrigeration compartment door 12.

The projecting catch 114 may be positioned at the front of the second connector 125. Here, the basket 110 may receive force through the second linking member 122 and be easily tilted about the stopper 115.

Figure 4:
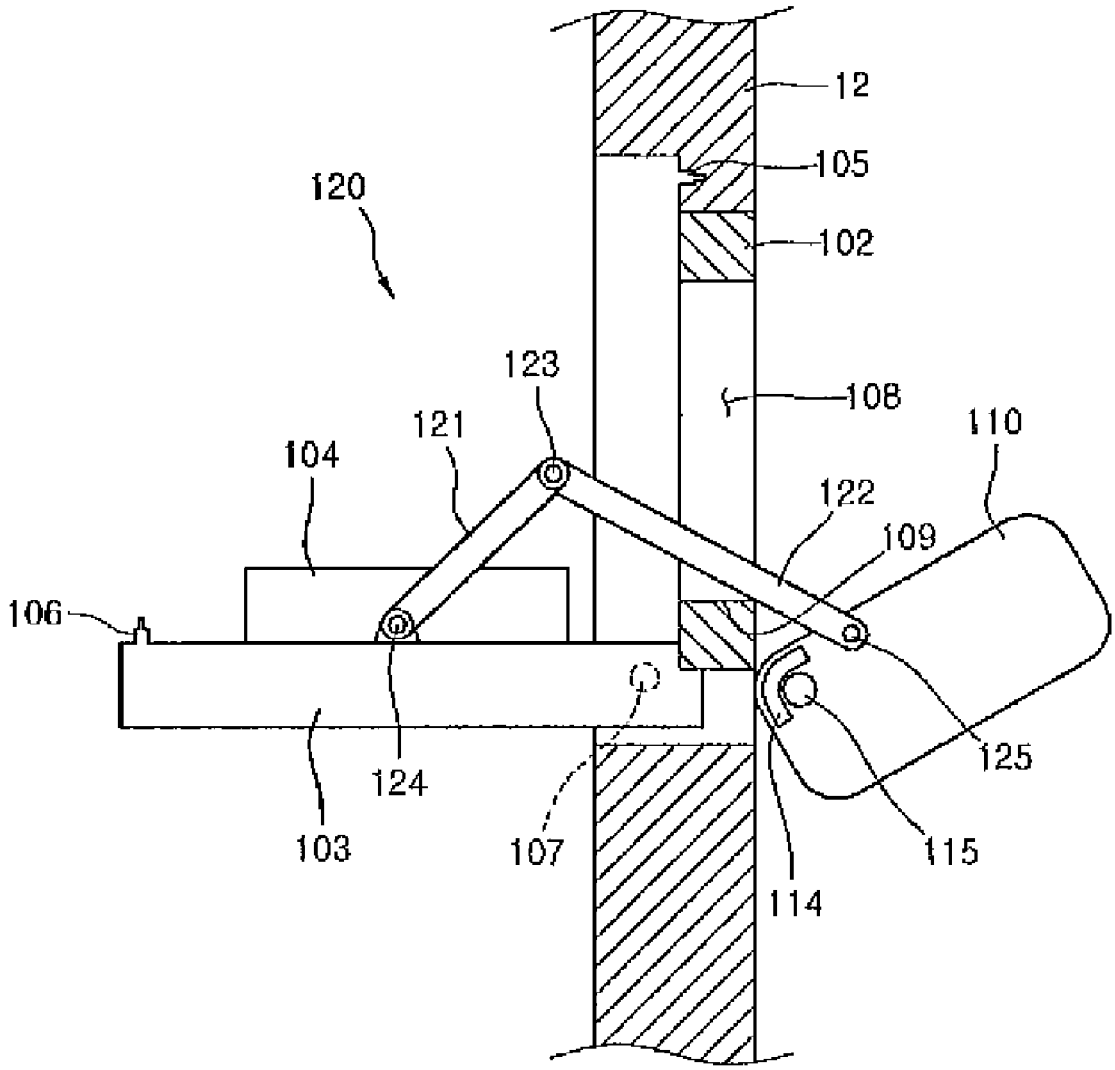
FIG. 4 is a sectional view of FIG. 1 cut along line I-I'.
Figure 5:
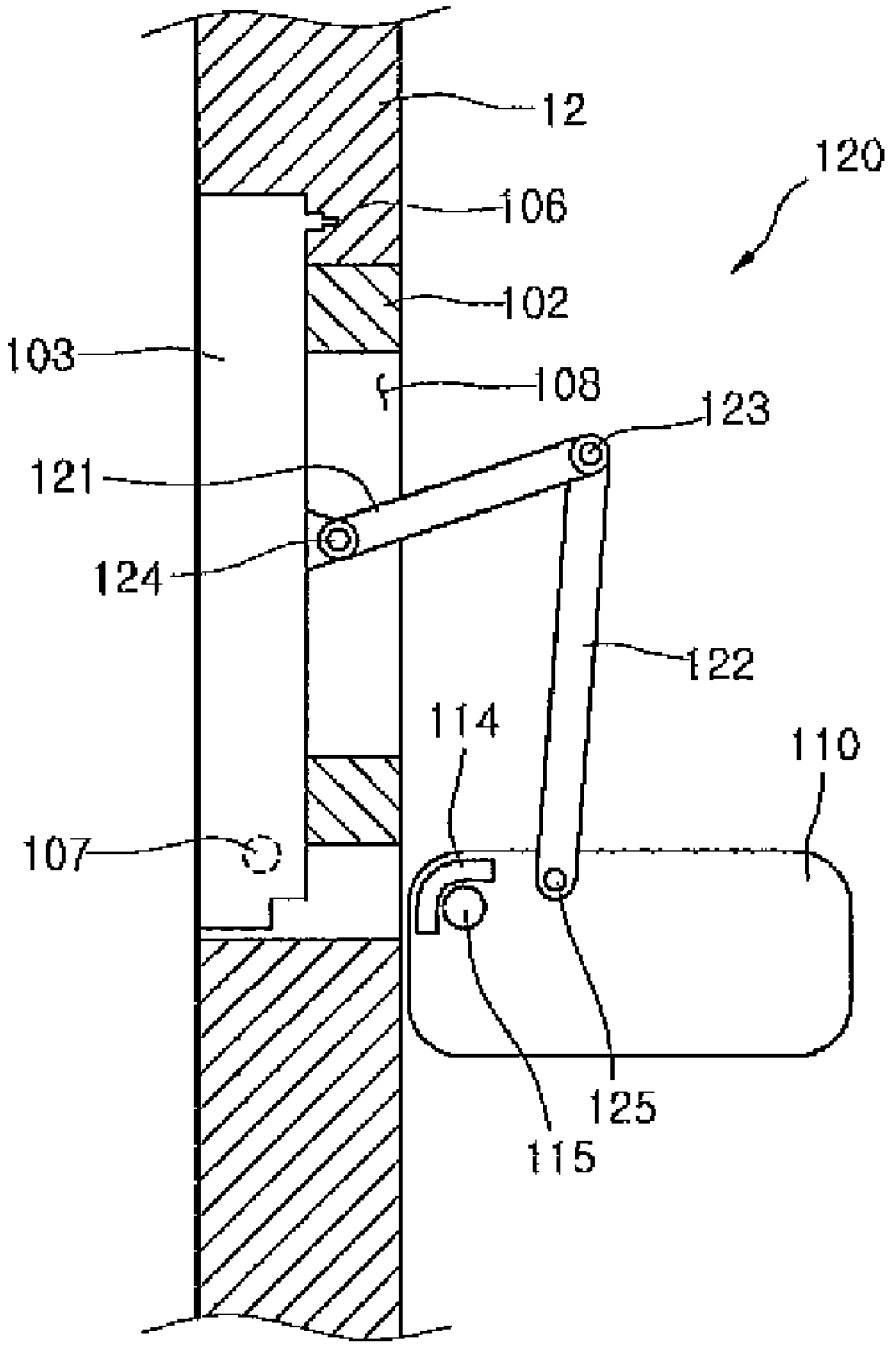
FIG. 5 is a sectional view showing the homebar door in a closed state.

FIG. 4 is a sectional view of FIG. 1 cut along line I-I', and FIG. 5 is a sectional view showing the homebar door in a closed state.

Referring to FIGS. 4 and 5, FIG. 4 shows the basket 110 being tilted by means of the connecting device 120 when the homebar door 103 is opened, and FIG. 5 shows the basket 110 being returned to its original state by means of the connecting device 120 when the homebar door 103 is closed.

In detail, when the homebar door 103 is being opened, the first linking member 121 moves in the opening direction of the homebar door 103, and the second linking member 122 moves in an external direction of the refrigeration compartment door 12 while connected to the first linking member 121.

Also, at least a portion of the second linking member 122 can contact the supporting edge 109 of the through-hole 108, and the basket 110 can be tilted by the second linking member 122. Here, the basket 110 is tilted about the stopper 15 of the refrigeration compartment door 12, so that the rear end of the basket 110 can be rotated upward while tilting.

Conversely, in the closing of the homebar door 103, the first linking member 121 can move toward the inside of the refrigeration compartment door 12 according to the pivoting of the homebar door 103.

Then, the second linking member 122 can be rotated in a predetermined direction about the coupling portion 123 according to the movement of the first linking member 121. Also, the basket 110, as shown in FIG. 5, can be returned to its original position by the rotation of the second linking member 122.

Through the above configuration, the basket 110 can be tilted simultaneously with the opening and closing of the homebar door 103, allowing a user to easily access items in the basket 110.

Below, the configuration of a homebar for a refrigerator according to the second embodiment of the present invention will be described. Because the only difference between the present embodiment and the first embodiment lies in the structure of the connecting device, reference numerals assigned to other like elements of the first embodiment will also be used in the present embodiment.

Figure 6:
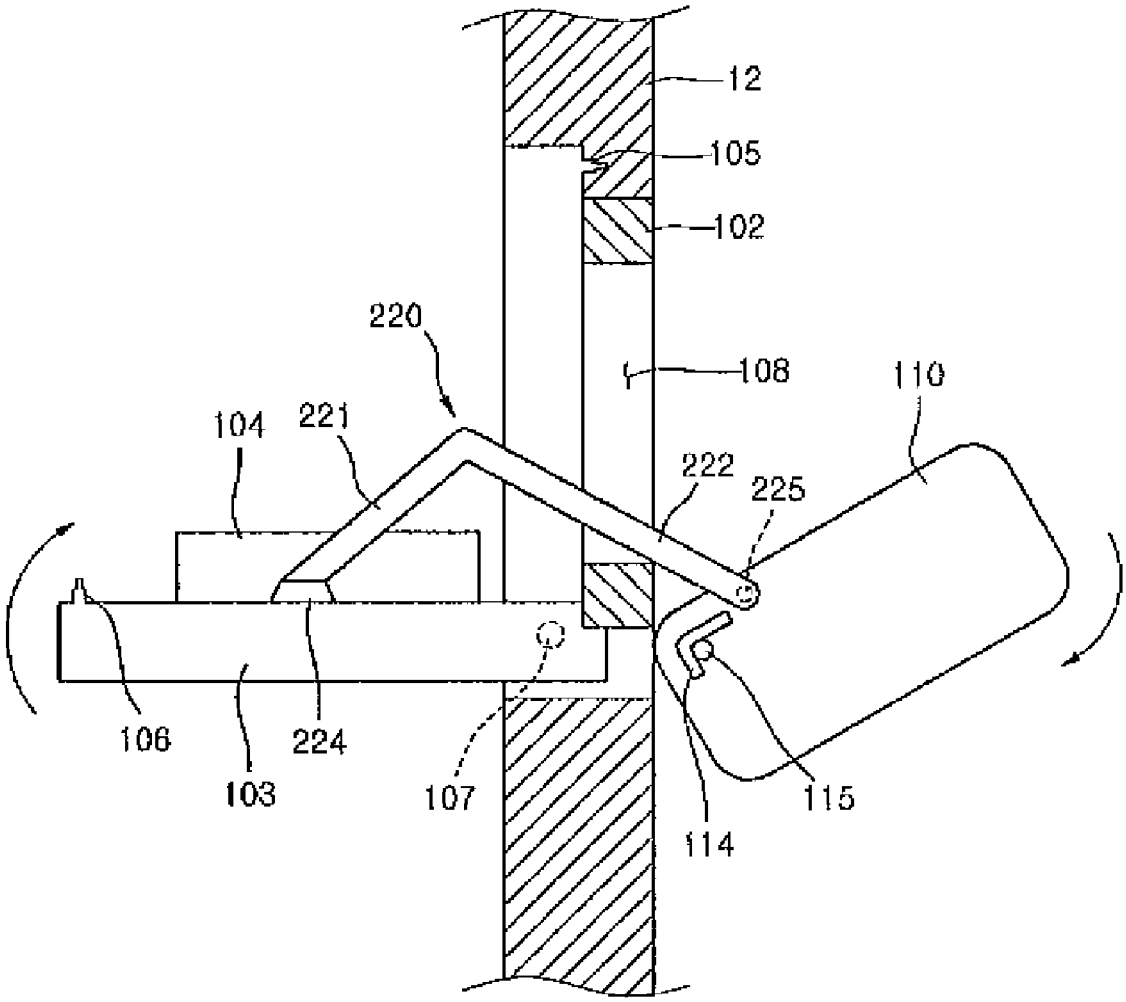
FIG. 6 is a sectional view showing the structure of a homebar for a refrigerator according to a second embodiment.

FIG. 6 is a sectional view showing the structure of a homebar for a refrigerator according to a second embodiment.

Referring to FIG. 6, a homebar 100 for a refrigerator according to the second embodiment of the present invention includes a connecting device 220 for connecting the homebar door 103 and the basket 110.

In detail, the connecting device 220 is configured with one linking member. The connecting device 220 includes a door connector 221 connected to the homebar door 103, and a basket connector 222 connected to the basket 110. Here, the door connector 221 and the basket connector 222 may be integrally formed.

One end of the door connector 221 is coupled to the inner surface of the homebar door 103, and one end of the basket connector 222 is coupled to a side surface of the basket 110. The connecting device 220 may be provided at either side of the basket 110.

A first connector 224 connected to the connecting device 220 is provided on the homebar door 103, and a second connector 225 connected to the connecting device 220 is provided on the basket 110.

The connecting device 220 has a rough "L" shape, and is fixed to the first connector 224 and the second connector 225.

Accordingly, the connecting device 220 retains its original shape when the homebar door 103 is pivoted or the basket 110 is tilted, and can maintain the same angle formed by the homebar door 103 and the basket 110.

The operation of the above connecting device 200 will now be described.

When the homebar door 103 is opened, the door connector 221 moves in the opening direction of the homebar door 103. Therefore, the basket connector 222 moves in the direction in which the door connector 221 moves, and thus, the basket 110 can receive force from the basket connector 222 and be tilted.

During closing of the homebar door 103, the door connector 221 moves in the closing direction of the homebar door 103. Accordingly, the basket connector 222 moves in the direction in which the door connector 221 moves, and thus, the basket 110 can receive force from the basket connector 222 and be returned to its original position.

Through the above configuration, the homebar basket can be simultaneously tilted or returned to its original position with the opening and closing of the homebar door.

Descriptions of the third and fourth embodiments of the present invention will be provided with reference to the drawings. Compared to the first embodiment and the second embodiment, the present embodiments are different only in the structures of the connecting device for the homebar and the basket, and therefore description will focus on the differences, and like reference numerals will be given to like elements in the first and second embodiments.

Figure 7:
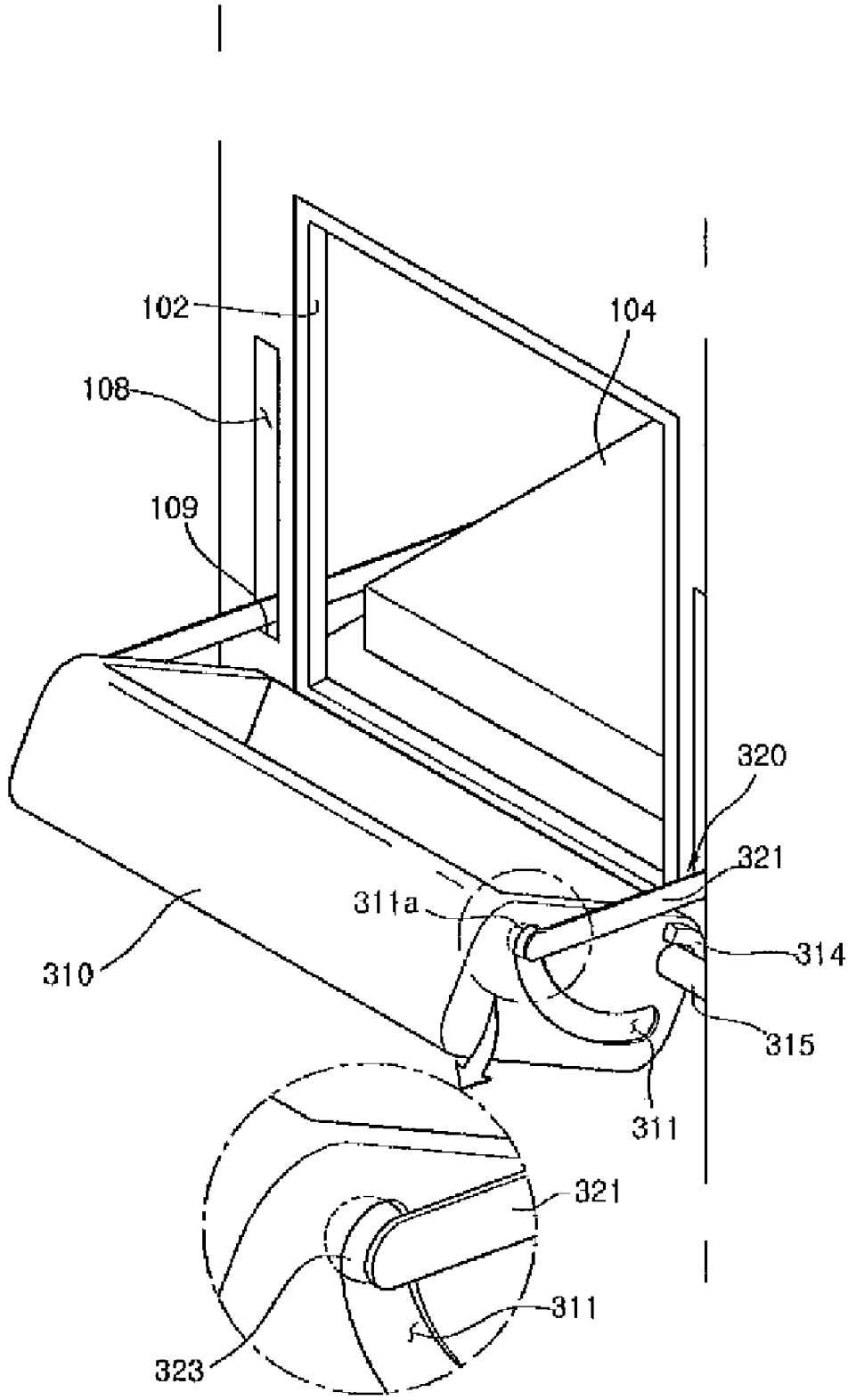
FIG. 7 is a rear perspective view of a homebar for a refrigerator according to a third embodiment.
Figure 8:
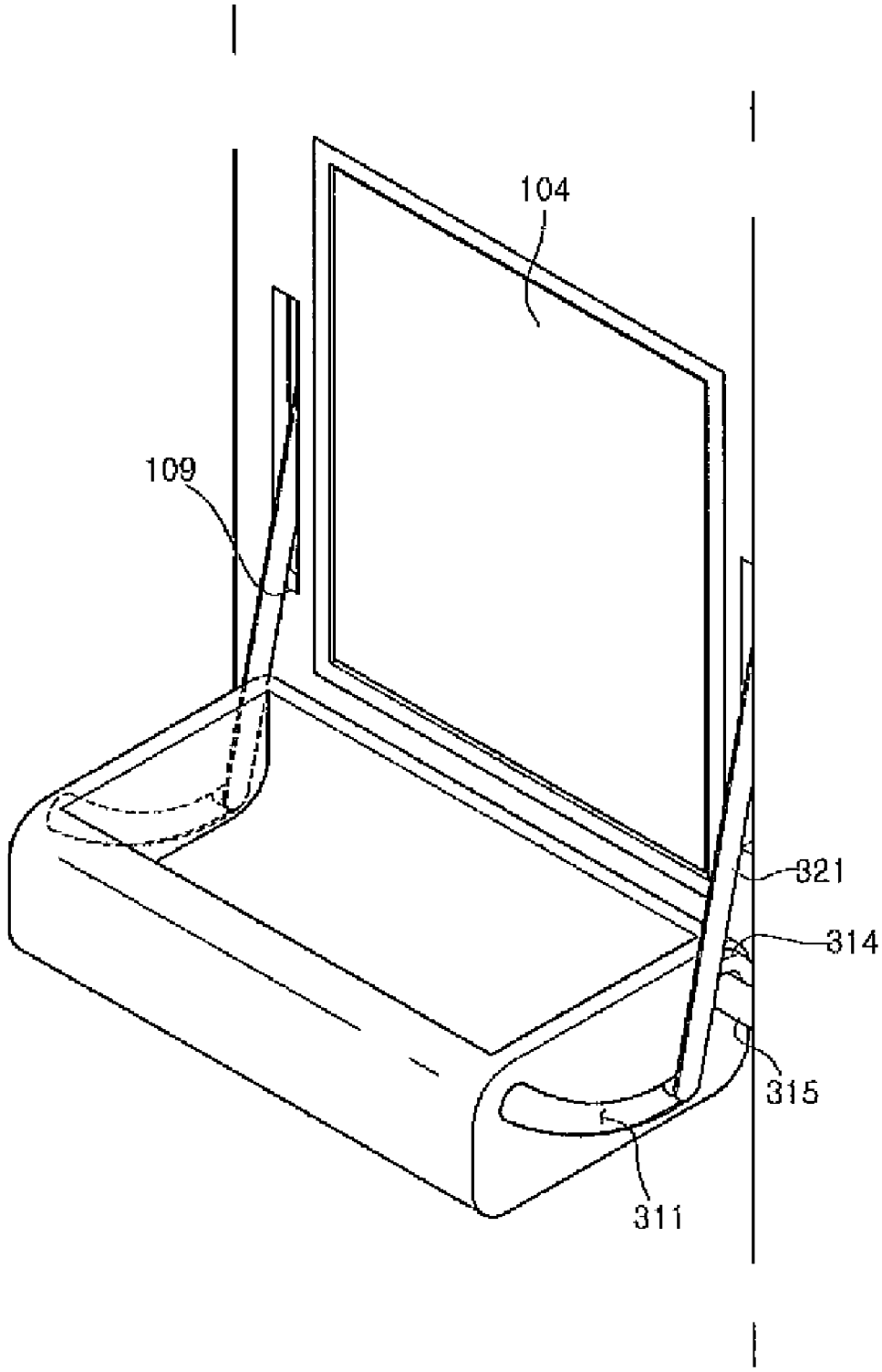
FIG. 8 is a perspective view showing a door of a homebar for a refrigerator according to the third embodiment in a closed state.

FIG. 7 is a rear perspective view of a homebar for a refrigerator according to a third embodiment, and FIG. 8 is a perspective view showing a door of a homebar for a refrigerator according to the third embodiment in a closed state.

Referring to FIGS. 7 and 8, a refrigeration compartment door 12 according to the third embodiment of the present invention includes a basket 310 that is tilted in a predetermined direction according to the opening and closing of the homebar door 103, and a connecting device 320 connected to the basket 310 for tilting the basket 310.

In detail, the connecting device 320 includes a linking member 321 that connects the homebar door 103 to the basket 310. The linking member 321 is provided in plurality—at the left side and the right side of the opening 101 of the homebar 100.

Configured in the shape of a bar, the linking member 321 has one end connected to the basket 310 and the other end connected to the rear surface of the homebar door 103.

Also, a fixing portion 124 (in FIG. 9) to which the linking member 321 is connected is provided on a side of the homebar door 103, and a guiding slot 311 to which the linking member 321 is movably attached is defined in a side of the basket 310.

The guiding slot 311 is formed rounded to enable the linking member 321 to easily pivot. That is, the guiding slot 311 is formed in a circular arc shape corresponding to the pivoting path of the linking member 321.

The guiding slot 311 defines a catching edge 311*a* that catches the linking member 321 and enables the basket 310 to be tilted in one direction.

Also, a rolling member 323 is provided at the bottom end of the linking member 321, and is inserted in the guiding slot 311 to roll along the guiding slot 311. Specifically, the rolling member 323 may be rotatably coupled to the linking member 321.

Below, the operation of a homebar door according to the third embodiment of the present invention will be described.

Figure 9:
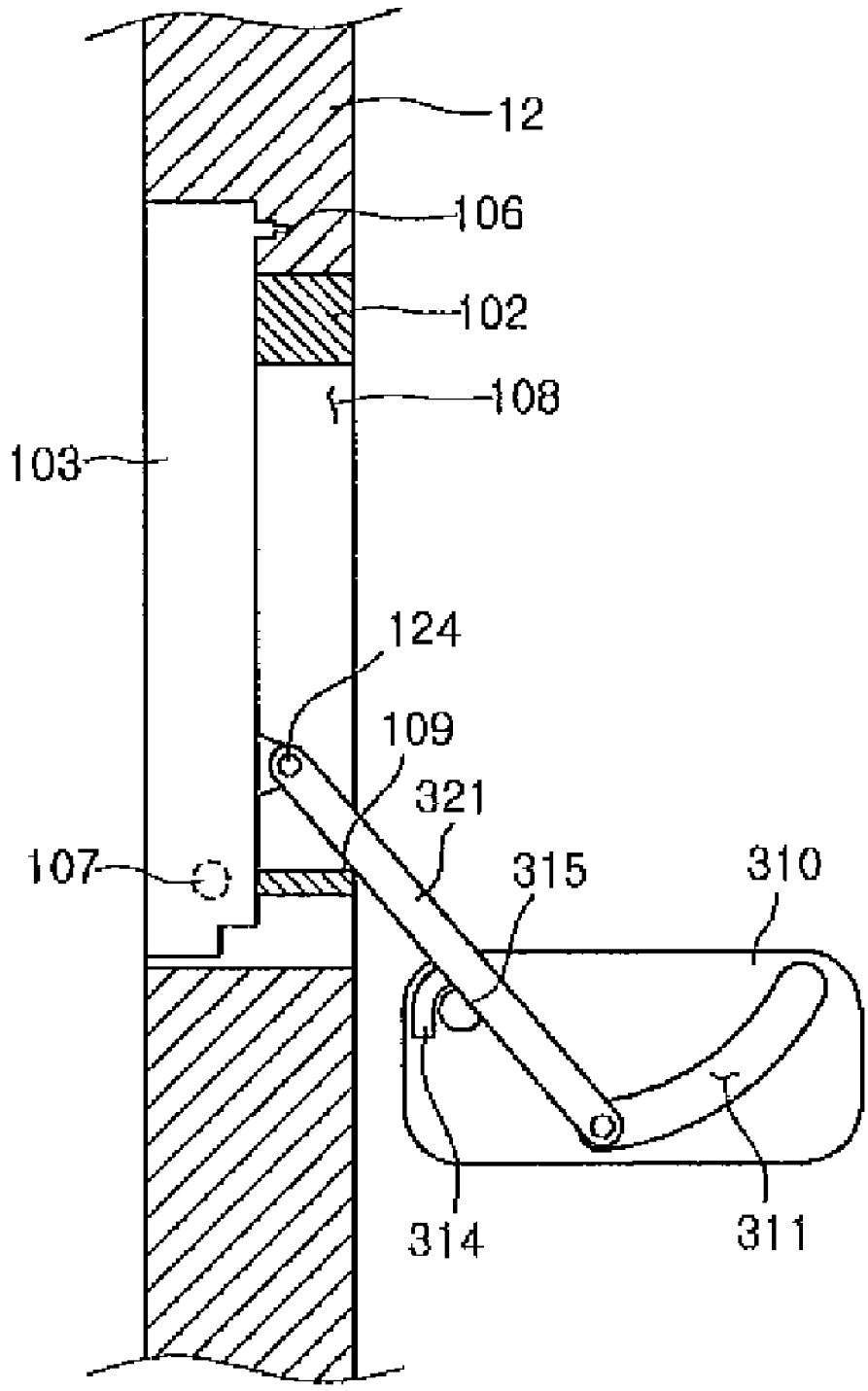
FIGS. 9 and 10 are sectional views showing a homebar door according to the third embodiment in closed and open states.
Figure 10:
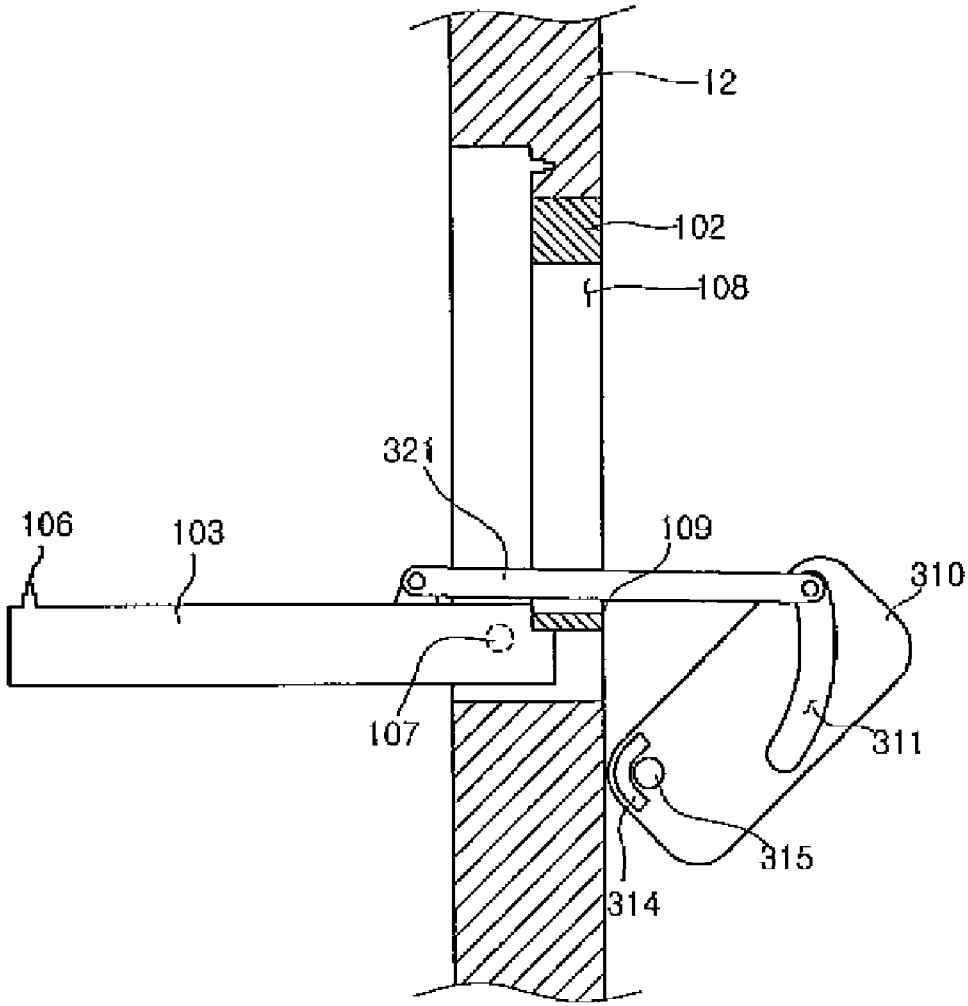

FIGS. 9 and 10 are sectional views showing a homebar door according to the third embodiment in closed and open states.

Referring to FIGS. 9 and 10, FIG. 9 shows the basket 310 returned to its original state by the connecting device with the homebar door 103 shut, and FIG. 10 shows a basket 310 according to embodiments of the present invention tilted by the connecting device 320 when the homebar door 103 is opened.

Below, a description of the linked tilting process of the basket 310 during the processes of the homebar door 103 being opened and closed will be provided.

First, in the opening process of the homebar door 103, the linking member 321 may rotate in the opening direction of the homebar door 321, or counterclockwise. Here, with the linking member 321 contacting the supporting edge 109, it can easily be rotated by means of the lever principle.

Then, the rolling member 323 connected to a side of the linking member 321 rolls along the guiding slot 311.

when the rolling member 323 catches on the catching edge 311*a* while moving, the rolling member 323 imparts force moving the basket 310 upward. During opening of the homebar door 103, the rolling member 323 presses against a side end of the guiding slot 311.

Then, the basket 310 may be tilted about the stopper 315.

Conversely, during closing of the homebar door 103, the linking member 321 can be rotated clockwise according to the pivoting of the homebar door 103. Here, with the linking member 321 in contact with the supporting edge 109, it can easily be rotated by means of the lever principle.

Thus, the basket 310 is rotated clockwise about the stopper 315. In this process, the rolling member 323 maintains a latched state with the catching edge 311*a* of the guiding slot 311.

When the basket 310 is returned to its original position, the linking member 321 continuously rotates clockwise, and the rolling member 323 rolls along the guiding slot 311.

When the linking member 321 is disposed at the other end of the guiding slot 311—that is, the end opposite to the catching edge 311*a*, the operation of the linking member 321 stops.

Below, a description will be provided of the structure of a homebar for a refrigerator according to the fourth embodiment of the present invention. Because the present embodiment differs from the third embodiment only in the structure of the connecting device, like descriptions and like reference numerals for like elements in the third embodiment will be used.

Figure 11:
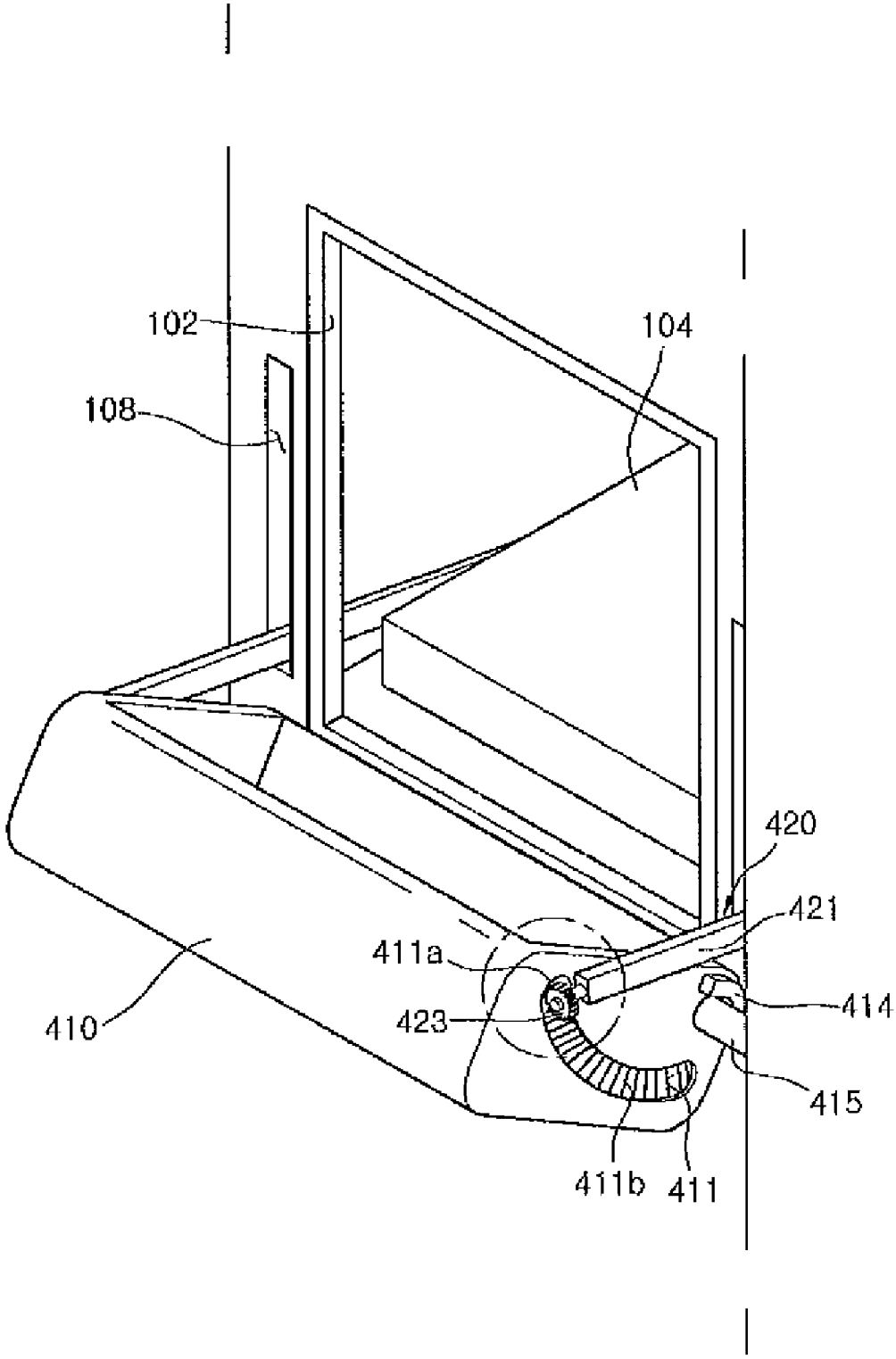
FIG. 11 is a rear perspective view of a homebar for a refrigerator according to a fourth embodiment.

FIG. 11 is a rear perspective view of a homebar for a refrigerator according to a fourth embodiment.

Referring to FIG. 11, a homebar 100 for a refrigerator according to the fourth embodiment of the present invention is provided with a connecting device 420 that connects the homebar door 103 and a basket 410.

In detail, the connecting device 420 includes a linking member 421 connecting the homebar door 103 and the basket 410, and a gear member 423 connected to a side of the linking member 421 to move along the guiding slot 411.

The gear member 423 is rotatably coupled to the linking member 421. The linking member 421 can easily pivot in a predetermined direction according to movement of the gear member 423.

A guiding slot 411 is defined in the basket 410 to guide the pivoting of the linking member 421. Also, the guiding slot 411 may be configured as a rack gear 411*a* corresponding to a pinion gear configuration of the gear member 423.

The gear member 423 may rotate and move along the rack gear 411*a*.

A brief description on the operation of the connecting device will be provided.

First, in the opening of the homebar door 103, the linking member 421 may rotate in the opening direction of the homebar door 103.

Then, the gear member 423 rotates and moves along the guiding slot 411. When the gear member 423 moves and then catches on the catching edge 411*a*, the gear member 423 imparts force to move the basket 410 upward.

Then, the basket 410 may be tilted about the stopper 415.

Conversely, when the homebar door 103 is closed, the linking member 421 can move in the closing direction of the homebar door 103 according to the pivoting of the homebar door 103.

Then, the basket 410 returns to its original position about the stopper 415.

In this process, the gear member 423 rotates and moves along the guiding slot 411, and the operation of the linking member 421 is stopped when one end of the linking member 421 reaches the end of the rack gear 411 opposite the catching edge 411*a*.

Through the above configuration and operation, a basket can easily be tilted or returned to its original position simultaneously with opening and closing of a homebar door by a user.

In the embodiments configured as above, because a homebar basket is connected to a homebar door, when the homebar door is opened and closed, the homebar basket can easily be tilted.

Also, because driving force from opening and closing the homebar door is transmitted to the homebar basket via a linking mechanism, the driving force transmitting configuration is simplified.

Further, because removal and insertion of items is made easy, user convenience is increased and product reliability is improved.

Through the above-described refrigerator, the operation of a homebar door and basket is made easier to increase user convenience.

Any reference in this specification to "one embodiment," "an embodiment," "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this invention. More particularly, various variations and modifications are possible in the component parts and/or arrangements of the subject combination arrangement within the scope of the invention, the drawings and the appended claims. In addition to variations and modifications in the component parts and/or arrangements, alternative uses will also be apparent to those skilled in the art.

What is claimed is:

1. A refrigerator comprising:

a main body defining a storage compartment;

a refrigerator door pivotably coupled to the main body and defining an opening;

a homebar door on the refrigerator door, for selectively opening and closing the opening, the homebar door being approximately at 90 degrees to the main body when the homebar door is rotated to be opened;

a basket pivotably provided on the refrigerator door; and a connecting device connecting the homebar door and the basket, for tilting the basket when the homebar door is pivoted, the connecting device comprising:

a first member coupled to the homebar door and configured to move when the homebar door is opened; and a second member coupled to the basket to transmit an operating force of the first member to the basket so that the basket can be rotated within the storage compartment at an angle less than a rotating angle of the homebar door, wherein the entire portion of the basket rotates within the storage compartment at an angle less than 90 degrees in a direction of rotation of the homebar door when the first and second members operate to open the homebar door.

2. The refrigerator according to claim 1, wherein the first and second members are rotatably coupled to one another.

3. The refrigerator according to claim 1, wherein the first member and the second member are formed as a single body.

4. The refrigerator according to claim 1, wherein the basket defines a guiding slot for guiding movement of the connecting device.

5. The refrigerator according to claim 4, wherein the guiding slot is a rack gear.

6. The refrigerator according to claim 1, wherein the refrigerator door defines a through-hole through which the connecting device passes in forward and rearward directions of the refrigerator door.

7. The refrigerator door according to claim 6, wherein the through-hole defines a supporting edge for supporting the connecting device.

8. The refrigerator according to claim 1, wherein the basket has one surface edge formed rounded.

9. The refrigerator according to claim 1, wherein the basket comprises a projecting catch for catching on the refrigerator door, and the refrigerator door comprises a stopper at a position corresponding to the projecting catch to provide a center of rotation for the basket.

10. A refrigerator comprising:

a main body defining a storage compartment;

a refrigerator door pivotably coupled to the main body, and defining an opening;

a homebar door pivotably coupled to the refrigerator door to selectively open and close the opening, the homebar door being approximately at 90 degrees to the main body when the homebar door is rotated to be opened;

a first member connected to a side of the homebar door and disposed to be capable of passing in forward and rearward directions through the refrigerator door;

a second member connected to the first member and being movable according to an operating force of the homebar door; and a basket provided to be pivotable according to movement of the second member, the basket comprising a guiding slot coupled to at least one portion of the second member so that the basket can be rotated at an angle less than a rotating angle of the homebar door according to the moving of the second member in a state where the basket is coupled to the refrigerator door within the storage compartment, wherein the entire portion of the basket rotates within the storage compartment at an angle less than 90 degrees in a direction of rotation of the homebar door when the first and second members operate to open the homebar door.

11. The refrigerator according to claim 10, wherein the first and second members comprise linking members.

12. The refrigerator according to claim 10, wherein the second member comprises a rolling member that rolls along the guiding slot.

13. The refrigerator according to claim 10, wherein the second member comprises a gear member for rotating and moving along the guiding slot.

14. The refrigerator according to claim 11, wherein the guiding slot has a shape corresponding to a pivoting trajectory of the second member.

15. The refrigerator according to claim 1, wherein the first and second members are linking members, and the first member and the second member have different link lengths.

16. The refrigerator according to claim 6, wherein the first member passes in the through-hole when the homebar door is closed, and the second member passes in the through-hole when the homebar door is opened.

17. The refrigerator according to claim 10, wherein the guiding slot is rounded corresponding to movement of the at least one portion of the second member.

* * * * *